United States Patent [19]

Horvath

[11] 4,296,571

[45] Oct. 27, 1981

[54] PROFILE GRINDING APPARATUS

[76] Inventor: Joseph Horvath, 11 Notch Rd., Clifton, N.J. 07013

[21] Appl. No.: 66,945

[22] Filed: Aug. 16, 1979

[51] Int. Cl.[3] ..... B24B 17/02; B24B 49/12; B24B 17/04

[52] U.S. Cl. ..... 51/32; 51/33 R; 51/35; 51/100 P; 51/165.72

[58] Field of Search ..... 51/100 P, 165.72, 32, 51/33 R, 34 R, 35, 47; 125/11 PT; 409/86, 89; 33/25 R

[56] References Cited

U.S. PATENT DOCUMENTS

| | | | |
|---|---|---|---|
| 1,325,789 | 12/1919 | Johnsson | 51/32 |
| 2,164,169 | 6/1939 | Wohlfarth | 51/165.72 |
| 2,248,446 | 7/1941 | Wohlfarth | 51/165.72 |
| 2,372,470 | 3/1945 | Bergstrom et al. | 51/165.72 |
| 2,384,527 | 9/1945 | Blesi | 51/165.72 |
| 2,465,010 | 3/1949 | Cooke | 51/165.72 |
| 2,465,038 | 3/1949 | Reams | 51/165.72 |
| 2,521,958 | 9/1950 | Angerby et al. | 51/100 P |
| 2,553,099 | 5/1951 | Lowber et al. | 51/165.72 |
| 2,600,402 | 6/1952 | Griffin | 51/100 P |
| 2,614,368 | 10/1952 | Polk et al. | 51/165.72 |
| 2,650,664 | 9/1953 | Allan et al. | 51/165.72 |
| 2,682,731 | 7/1959 | Studer | 51/100 P |
| 2,828,583 | 4/1959 | Carlsen | 51/33 R |
| 3,031,803 | 5/1962 | Ohyagi | 51/32 |
| 3,143,831 | 8/1964 | Banko | 51/165.72 |
| 3,533,191 | 10/1970 | Mason | 51/165.72 |

FOREIGN PATENT DOCUMENTS

| | | | |
|---|---|---|---|
| 1023359 | 1/1958 | Fed. Rep. of Germany | 51/165.72 |
| 2654404 | 6/1978 | Fed. Rep. of Germany | 51/165.72 |

*Primary Examiner*—Harold D. Whitehead
*Assistant Examiner*—K. Bradford Adolphson
*Attorney, Agent, or Firm*—Caesar, Rivise, Bernstein & Cohen, Ltd.

[57] ABSTRACT

A profile grinding apparatus comprising a stationary frame, a template support table and a workpiece support table. The workpiece support table is mounted at a fixed position on the frame. A pantograph and parallelogram assembly is mounted on the frame for horizontal movement in response to the movement of guiding means. A first movable support is mounted on the frame coupled to the pantograph and parallelogram for following movement of the guide means. A second movable support is mounted on the frame below the first movable support means and coupled thereto for movement therewith. A vertically reciprocable grinding assembly is carried between the first and second movable supports to grind a contour on the workpiece mounted on the workpiece table. A shadowgraph is located on the frame at a fixed position adjacent the workpiece table for projecting an image of the profile of the workpiece. The grinding means is also arranged for reciprocation at an acute angle to the vertical axis. The template table includes means for coupling the guiding means of the pantograph thereto to enable the pantograph to move the grinding means in response to the movement of the template holding table. The first and second supports which carry the grinding means are mounted on the fixed frame and coupled to the pantograph by a movable support assembly including a pair of vertical rods and associated brackets.

14 Claims, 14 Drawing Figures

FIG. 5
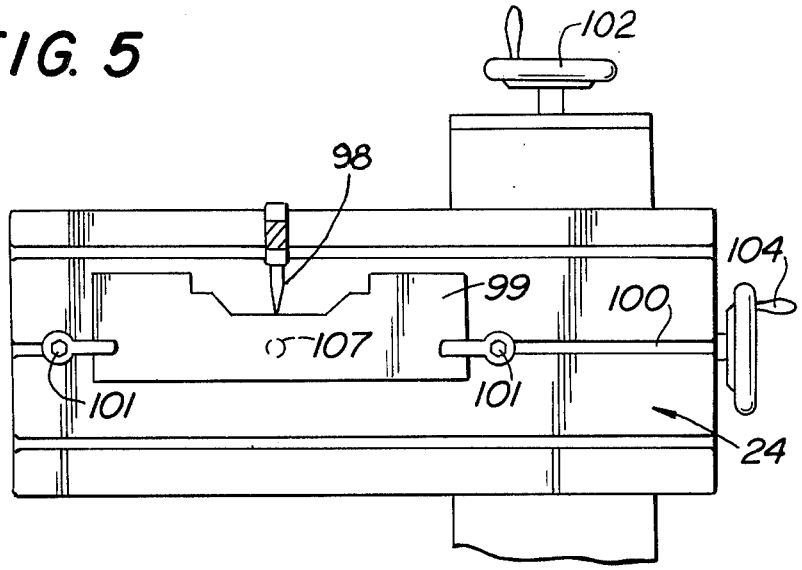
FIG. 7
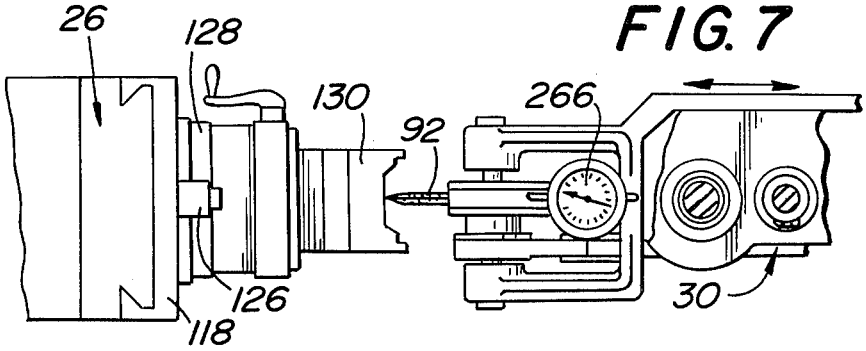
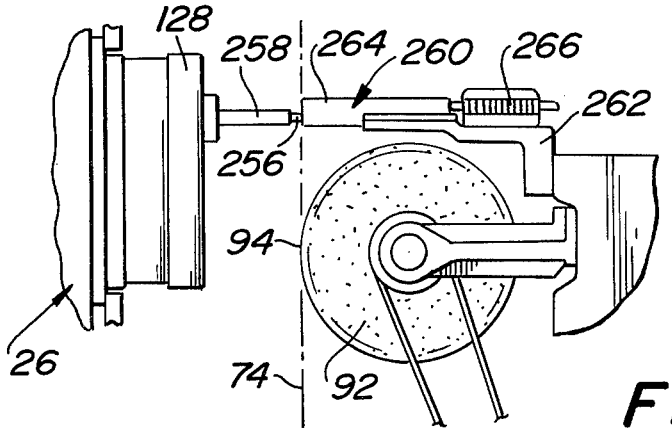
FIG. 8

FIG. 9
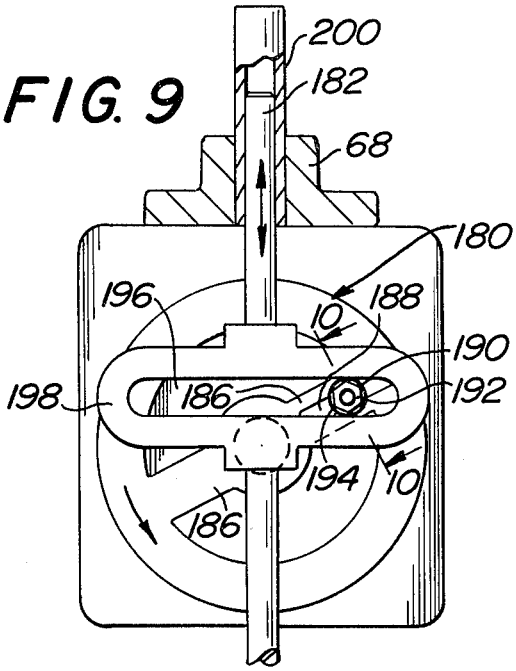
FIG. 10
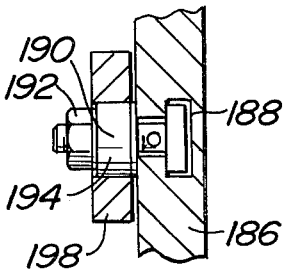
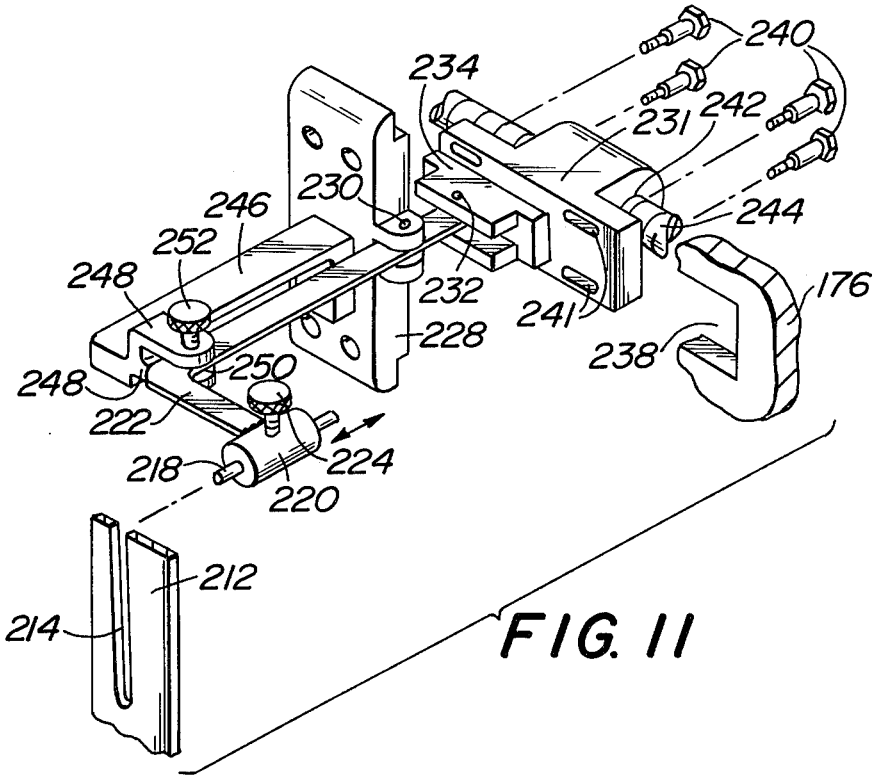
FIG. 11

PROFILE GRINDING APPARATUS

This invention relates to grinding apparatus and more particularly to profile grinding apparatus for displaying the profile of a workpiece being ground.

BACKGROUND OF THE INVENTION

Various grinding apparatus have been disclosed in the patent literature for grinding a workpiece to a desired profile. such apparatus commonly make use of a pantograph assembly or the like to move the grinding wheel to correspond to the movement of a stylus along a template or guide. Examples of such apparatus are shown in U.S. Pat. Nos. 2,164,169 (Wohlforth), 2,248,446 (Wohlforth), 2,521,958 (Angerby et al), 2,553,099 (Lowber et al), and 2,600,402 (Griffin). Various United States patents have even disclosed the use of optical means to provide an image of the profile of the workpiece during the grinding operation. Examples of such optical means are found in such U.S. patents as U.S. Pat. Nos. 2,164,169 (Wohlforth), 2,248,446 (Wohlforth), 2,372,470 (Bergstrom et al), 2,465,038 (Reams), 2,614,368 (Polk et al), 3,039,239 (Banko) and 3,143,831 (Banko).

Commercially available profile grinding apparatus commonly utilize a pantograph to carry a grinding wheel along a path corresponding to the profile of a template or a guide. For example Fritz Studer Limited of Clockenthal-Thun, Switzerland produces a profile grinding machine using a pantograph-parallelogram assembly for carrying a grinding wheel to the profile of a template. The grinding wheel is moved in a horizontal plane in response to the movement of a stylus about the periphery of the template. The workpiece to be ground is mounted on a table which reciprocates vertically while the grinding wheel remains stationary to profile the workpiece to the contour of the template. Other manufacturers offer similar type profile grinding apparatus, while various manufacturers, such as the Cinncinnati Milling Machine Co., of Cinncinnati, Ohio, Wickman, Limited of Coventry England, and Eric R. Bachmann Company, Inc. of Long Island City, N.Y., offer grinding apparatus having means for optically displaying the profile of the workpiece being ground.

Optical devices themselves are commercially available for use with machining apparatus for projecting an image of the workpiece onto the screen. Such devices are commonly referred to as "shadowgraphs" since the image projected represents the shadow of the profiled workpiece. Shadowgraphs are commonly arranged to display the desired profile of the workpiece to be ground, via the use of an overlay. With such devices the machinist can readily compare the shape of the workpiece during the machining operation to the desired profile in order to precisely contour the workpiece.

While shadowgraphs and other similar optical devices have great potential for profile grinding applications, the use of such devices on relatively simple pantograph-mounted grinding apparatus is not without limitation. The most substantial limitation is that it is difficult to maintain a focused image of the workpiece during the grinding operation since the workpiece is moved by the vertically reciprocating table with respect to the fixed position, pantograph-mounted grinding wheel. Some grinding apparatus have attempted to overcome this problem by mounting the optical viewing device for corresponding movement with the pantograph. See for example the U.S. Pat. Nos. 2,164,169 (Wohlforth) and 2,248,446 (Wohlforth).

Accordingly, it is a general object of the instant invention to provide a profile grinding apparatus which overcomes the disadvantages of the prior art.

It is a further object of the instant invention to provide a profile grinding apparatus having means for displaying an image of the profile of the workpiece during operation.

It is a further object of the instant invention to provide a profile grinding apparatus including grinding means carried by a pantograph assembly and arranged for vertical reciprocation.

It is still a further object of this invention to provide profile grinding apparatus including means for displaying a constantly focused image of the profile of the workpiece during grinding and which apparatus is simple in construction.

It is still a further object of this invention to provide profile grinding apparatus including pantograph means for moving a grinding assembly through a path corresponding to the contour of the template or to the movement of a template holding table.

It is yet a further object of this invention to provide profile grinding apparatus capable of grinding a bevelled edge on a workpiece.

SUMMARY OF THE INVENTION

These and other objects of the invention are achieved by providing a profile grinding apparatus comprising a stationary frame, a first table adapted for holding a template thereon and mounted on the frame and a second table adapted for holding a workpiece at a fixed position on the frame. The apparatus also comprises pantograph means movable in a horizontal plane in response to the positioning of a guiding means and first and second movable support means mounted on the stationary frame. The first support means is coupled to the pantograph for following the movement of the guiding means. The second support means is mounted on the stationary frame below the first movable support means and coupled to the first movable support means for movement therewith. Vertically reciprocable grinding means are carried by the first and second removable support means to grind the contour of the workpiece held on the second table. Optical means are located adjacent the work table for displaying an image of the profile of the workpiece. The template holding table is adjustable in a horizontal plane and includes means for coupling the guiding means thereto for effecting movement of the grinding means in a horizontal plane.

Other objects and many of the attendant advantages of this invention will be readily appreciated as the same becomes better understood by reference to the following detailed description when considered in connection with the accompanying drawing wherein:

BRIEF DESCRIPTION OF THE DRAWING

FIG. 5 is an enlarged, sectional view taken along line 5—5 of FIG. 2;

FIG. 7 is a sectional view taken along line 7—7 of FIG. 6;

FIG. 8 is a side-elevational view of a portion of the apparatus shown in FIG. 2;

FIG. 9 is an enlarged sectional view taken along the line 9—9 of FIG. 2;

FIG. 10 is an enlarged sectional view taken along the line 10—10 of FIG. 9;

FIG. 11 is an enlarged perspective view, partially in section, of a portion of the apparatus shown in FIG. 6;

DESCRIPTION OF THE PREFERRED EMBODIMENT

Figure 1:
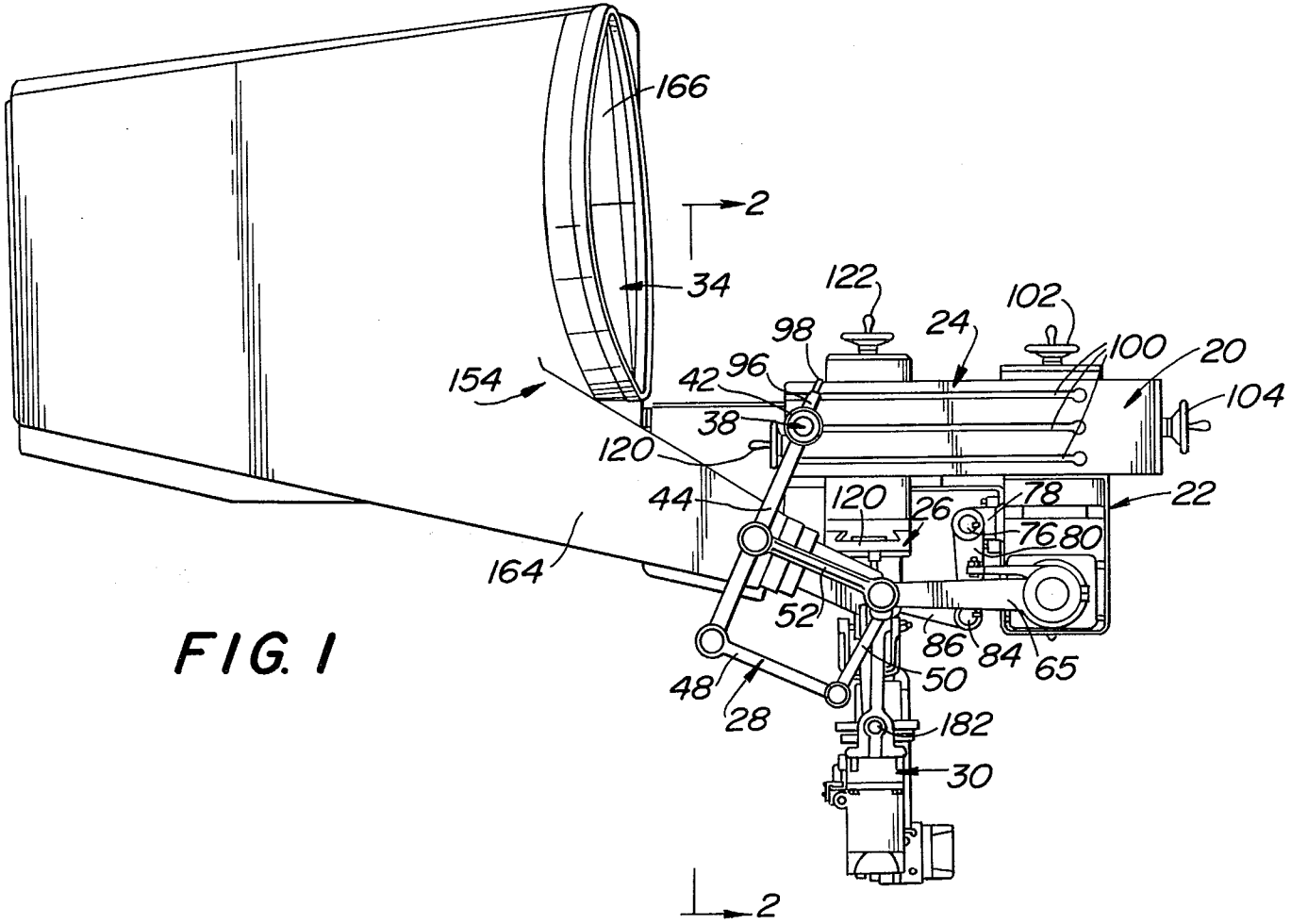
FIG. 1 is a top plan view of the profile grinding apparatus in accordance with the instant invention.
Figure 2:
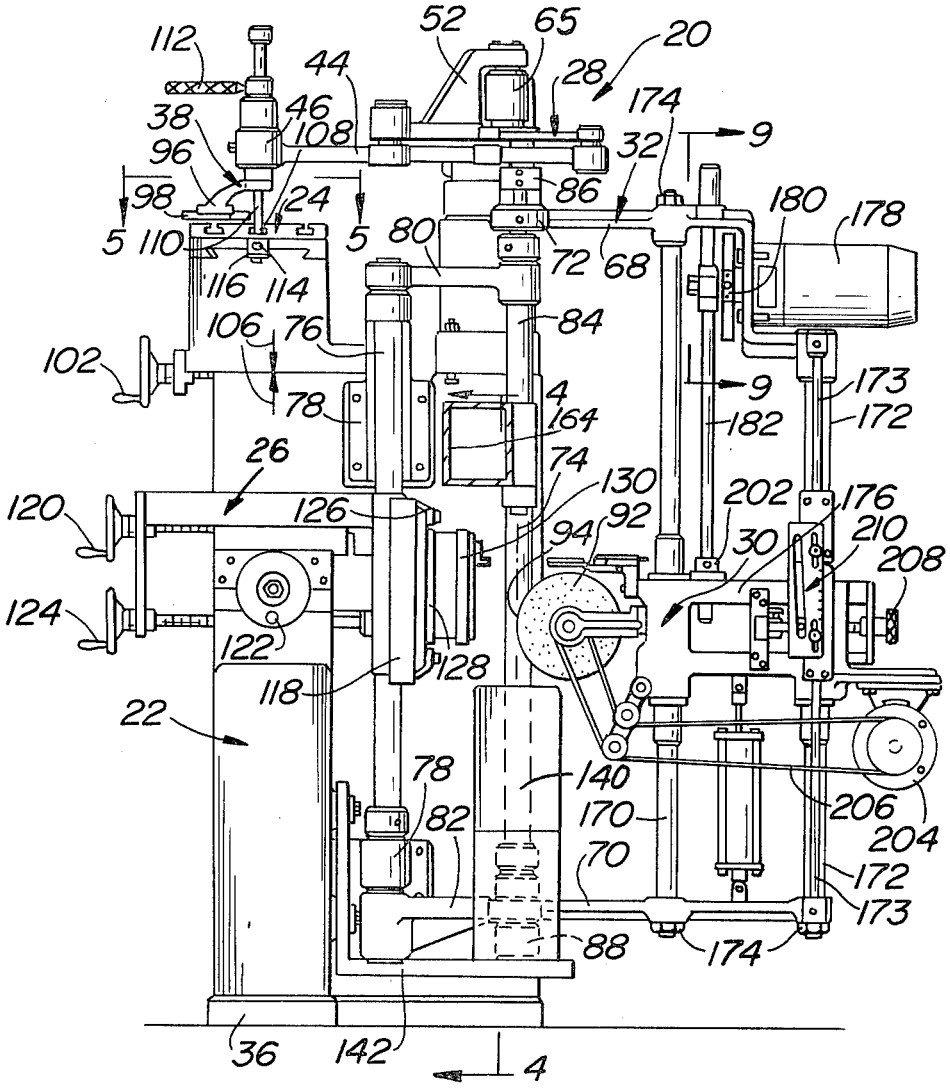
FIG. 2 is a sectional view taken along line 2—2 of FIG. 1.

Referring now in greater detail to the various figures of the drawing wherein like reference characters refer to like parts, there is shown generally at 20 in FIGS. 1 and 2 a profile grinding apparatus and having optical means for displaying an image of the workpiece. The apparatus shown in FIGS. 1 and 2 is arranged to grind a workpiece to a desired profile, which profile is established by the movement of a stylus about the periphery of a template held on a table or by the movement of the table itself, and to provide an image of the profile of the workpiece during grinding.

The apparatus 20 basically comprises a stationary housing or frame 22, a template holding table 24, a workpiece holding table 26, profile translation means 28, grinding means 30, a movable support assembly 32, and optical image display means 34. The fixed frame 22 comprises a base 36 adapted for disposition on the floor of a building. The frame 22 supports the template holding table 24 in a horizontal plane. The table is movable in the X and Y directions in the horizontal plane under the control of a pair of hand wheels, to be described later. The fixed frame 22 also supports the workpiece holding table 26, which is adjustable in three orthagonal directions, i.e. X, Y and Z, under control of three hand wheels, also to be described in detail later, to enable the workpiece to be brought into precise positioning required for the grinding operation.

The profile translation means 28 is arranged to move the grinding means 30 in the precise path taken by guiding means 38 coupled thereto. The profile translation means 28 basically comprises a pantograph 40 to which the guiding means is connected. The pantograph 40 is of conventional construction and includes pivotably interconnected arms for translating the rectilinear movement of the guiding means into corresponding rectilinear movement of an output member but on a reduced scale. The grinding means 30 is coupled to the pantograph output member. In order to enable the guiding means to swivel about a vertical axis and to transmit the swivelling motion on a reduced scale to the output member, and hence to the coupled grinding means, the profile translation means also includes a triple linkage, parallelogram assembly 42. The parallelogram assembly is of conventional construction and, as will be described in detail later, is connected to the arms of the pantograph 40.

In accordance with one aspect of this invention the guiding means 38 utilizes a stylus (to be described in detail later) which is adapted to be moved in any direction in a horizontal plane so that it follows the contour of the periphery of a template held on table 24. In accordance with another aspect of this invention the guiding means 38 utilizes an extendable rod or shaft adapted to couple the guide means directly to the table 24 so that the guide means can be moved by the table itself.

In the interest of drawing simplicity only the pantograph portion of the translation means 28 is shown in FIGS. 1 and 2. However, in FIG. 4 the prallelogram assembly 42 is shown in detail connected to the pantograph 40 as it exists in the apparatus 20.

Figures 3, 14:
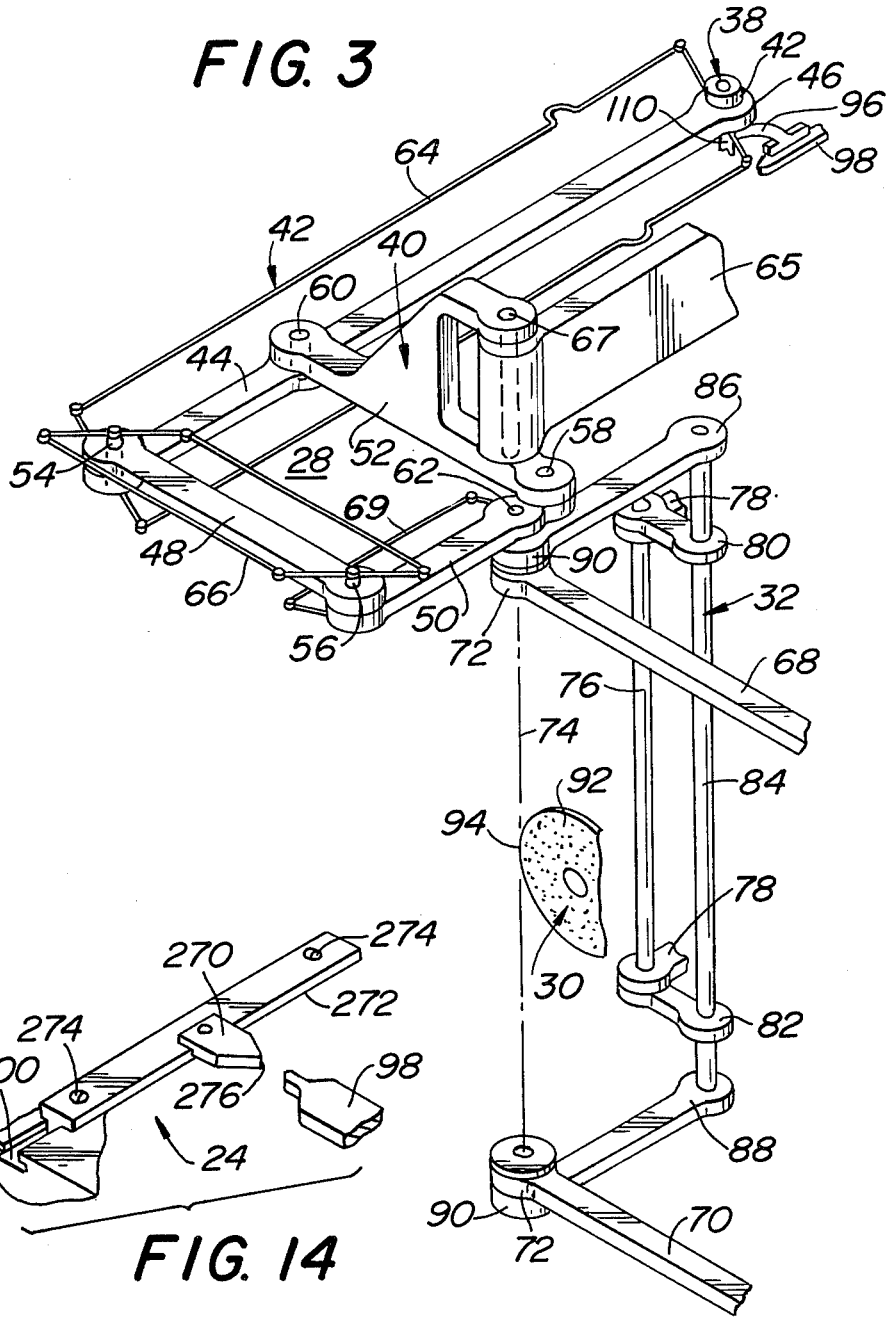
FIG. 3 is an enlarged perspective view of a portion of the pantograph and grinder supporting apparatus shown in FIGS. 1 and 2.
FIG. 14 is a perspective view of means used with the apparatus to effect the profiling of a grinding wheel.

Referring now to FIG. 3 it can be seen that the pantograph 40 comprises an elongated arm 44 having a free end 46, at which the guiding means 38 is mounted, and interconnected arms 48, 50 and 52. One end of the arm 48 is connected to one end of arm 44 at a vertical pivot pin 54. The other end of arm 48 is connected to one end of arm 50 at a vertical pivot pin 56. The other end of arm 50 is connected to one end of arm 52 at a vertical pivot pin 58. The other end of arm 52 is connected to the midportion of arm 44 at vertical pivot pin 60. The output of the pantograph 40 is provided at a vertical pivot pin 62 located in arm 50. Accordingly, any motion of the guiding means 38 in the horizontal plane is directly followed by the pin 62, but on a reduced scale. In the embodiment shown herein the reduction ratio produced by the pantograph is 10:1. Other reduction ratios can be established by changing the length of the pantograph arms and amount of pivot offset, as is conventional. The parallelogram 40 basically comprises three sets of parallelogram linkages 64, 66 and 69 connected in a conventional manner to the the pantograph arms 44, 48 and 50, respectively. To that end, the linkage 64 is connected between the guiding means 38 and pivot pin 54 of pantograph arm 44, the linkage 66 is connected between pivot pin 54 and pivot pin 56 of pantograph arm 48 and the linkage 69 is connected between pivot pin 56 and output pivot pin 62 of pantograph arm 50.

The profile translation means 28 is supported on the fixed frame 22 of the apparatus by a horizontally extending support beam 65. To that end the pantograph arm 52 is connected via a swivelling pivot pin 67, to the free end of beam 65. The pivot pin 67 is located intermediate pivots 58 and 60, but closely adjacent to pivot 58.

As will be described in detail later, the grinding means 30 is supported for vertical reciprocation in a movable frame which is coupled, via the movable support assembly 32, to the output pin 62 of the pantograph 40. The movable support means 32 is arranged to couple the movement of the output pin 62 to upper and lower support members of the frame supporting the grinding means. The details of the frame supporting the grinding means will be described in detail later, suffice for now to say the frame includes an upper movable support member 68 and a lower movable support member 70. Each support member includes a pivoting end 72. The pivoting end 72 of upper support 68 is connected directly to output pivot pin 62 of the pantograph. The pivot end 72 of lower movable support 70 is located along the vertical axis 74 extending through the output pivot pin 62 of the pantograph. Accordingly, both movable members 68 and 70 are pivotable about the vertical axis 74 extending through the output of the pantograph.

The movable support assembly 32 is provided in order to maintain the movable supports 68 and 70 with their pivoting ends coaxial with the axis 74, so that the grinding means precisely follows the movement of the guiding means 38. The assembly 32 basically comprises a first vertically extending rod 76 mounted between a spaced pair of bearings 78 fixedly secured on the frame 22 so that the rod can rotate about its vertical axis. A bracket 80 is fixedly secured to the upper end of rod 76 while a similar bracket 82 is fixedly secured to the lower end of the rod. A second rod 84 is journalled in the free ends of respective brackets 80 and 82, with its longitudinal axis vertical. Accordingly, the rod 84 is rotatable about its own axis within brackets 80 and 82 and pivotable in a orbital path about the axis of rod 76. A bracket 86 is fixedly secured to the upper end of rod 84 while a similar bracket 88 is fixedly secured to the lower end of rod 84. The bracket 86 is an elongated member whose end 90 is connected to the output pin 62 of the pantograph and to the parallelogram on axis 74. The bracket 88 is of similar construction to bracket 86 and includes a pivot end 90 which is pivotably connected to the pivot end 72 of movable support 70 coaxial with axis 74.

It will thus be appreciated that the rods 76 and 84 and the associated brackets of the movable support assembly 32 provide structural support for the frame holding the grinding means while enabling the grinding means to be moved through the path described by the output of the pantograph. As will be described in detail later, the grinding means 30 includes a rotary grinding wheel 92 having a peripheral cutting edge 94. The wheel 92 is mounted between the movable supports 68 and 70 so that its cutting edge 94 is tangent to the axis 74. The grinding means is reciprocable vertically between the supports 68 and 70 so that the periphery 94 of the grinding wheel 92 lies along and is tangent to the axis 74 at all times during reciprocation, unless, it is desired that the wheel reciprocates slightly horizontally, i.e., in and out, during vertical reciprocation to follow a path at an acute angle to axis 74. The latter action is used to grind a bevelled edge onto a workpiece.

The optical display means 34 will be described in detail later. Suffice for now to say that it is of the shadowgraph type and includes a screen for providing an enlarged image of the profile of the actual workpiece held on the workpiece table 26. The screen may also display the desired profile for the workpiece. Inasmuch as the workpiece table 26 remains stationary while the grinding means 30 reciprocates vertically during the grinding operation, the image provided by the optical display means 34 remains in focus at all times. This feature is of considerable importance to the machinist in order to readily produce a precisely contoured workpiece.

Referring now to FIG. 2 the guiding means 38 will be described. The guiding means comprises a stylus support 96 for holding a stylus 98 in a horizontal plane. The support 96 is journalled within the end of the pantograph arm 44 and coupled to the parallelogram linkage 64 so as to be rotatable about a vertical axis. The stylus 98 is mounted normal to the vertical axis and with its working end coaxial therewith. Accordingly, the stylus is positionable in all directions in a horizontal plane over table 24 while also being able to swivel about the vertical axis of the guiding means. These features enable the stylus to move along and follow the precise contour of a template 99 mounted on the table 24 (FIG. 5). The template establishes the profile of the workpiece to be ground.

The table 24 includes a plurality of longitudinally extending slots 100 which, through the coaction of clamps 101, serve as means for securing the template onto the table. The table 24 is adjustable in the X and Y directions in the horizontal plane under the control of a pair of adjustment hand wheels 102 and 104. The wheels 102 and 104 are rotated to move the template holding table so that a template mounted thereon and which centered at a point 108 (to be described later) into precise alignment with a pattern superimposed on the screen of the shadowgraph 34. The alignment of the pattern on the shadowgraph screen with the template held on the table 24 is necessary for calibrated operation and is accomplished by moving the table until zero marks 106 (FIG. 2) on the table 24 and the stationary housing 22 are aligned.

In accordance with another aspect of this invention the template holding table 24 includes an opening 108 which is utilized in combination with an extendable shaft of the guide means 38 for centering the pantograph with respect to the optical display means. In addition the opening is used to directly move the pantograph and hence the grinding means carried thereby under the control of the hand wheels 102 and 104 of the table 24. To that end the guide means 38 includes an extendable vertical shaft journaled in the free end of the pantograph arm 44 and connected to the parallelogram linkage 64. The axis of the shaft is coaxial with the vertical axis of the guide means 38. The shaft 110 is arranged to be extended and retracted vertically.

When the shaft 110 is retracted the control of the grinding means is effected by the movement of the stylus 98 about the periphery of the template 99. When the movement of the grinding means is to be controlled directly by the movement of the table 24, the shaft 110 is extended vertically downward along the vertical axis of the guide means 38 and into the opening 108. The shaft 110 is locked in the extended position by the rotation of a locking handle or bar 112 and it is secured in the opening 108 by a screw 114 in a bushing 116.

It should be appreciated from the foregoing that the apparatus 20 is capable of two types of contour grinding operations. To that end, when the shaft 110 is secured to the table 24 the apparatus is adapted for visual grinding without the use of a template by merely moving the table under the control of the wheels 102, 104 to follow a pattern, e.g. an overlay, appearing on the screen of the shadowgraph 34. When the shaft 110 is freed from the table 24, the apparatus is adapted for grinding to the contour of a template held on table 24.

The workpiece holding table 26 is shown clearly in FIGS. 2, 5, 6 and 7. As can be seen table 26 includes a movable holder 118 or plate which is disposed vertically. The plate is arranged to be moved in three orthagonal directions for adjustment by three hand wheels 120, 122 and 124. The rotation of wheel 122 moves the plate in the horizontal direction to the right and to the left as shown in FIG. 2, the rotation of wheel 120 moves the plate in and out (90° to the movement of the plate as controlled by wheel 122) and the rotation wheel 124 moves the plate up and down.

The vertical adjustability of the table 26, enables the workpiece to be brought into focus for the shadowgraph, while the horizontal adjustability of the table enables the workpiece to be moved in the shadowgraph's focal plane to align the profile of the actual workpiece with the desired profile, e.g. overlay, appearing on the screen.

The plate 118 includes clamping means 126 for clamping a magnetic workpiece holder 128 on the surface of the plate 118. The holder 128 is arranged to magnetically hold a workpiece 130 in place to contour the workpiece to the desired profile as is established by the movement of the guiding means 38.

Figure 4:
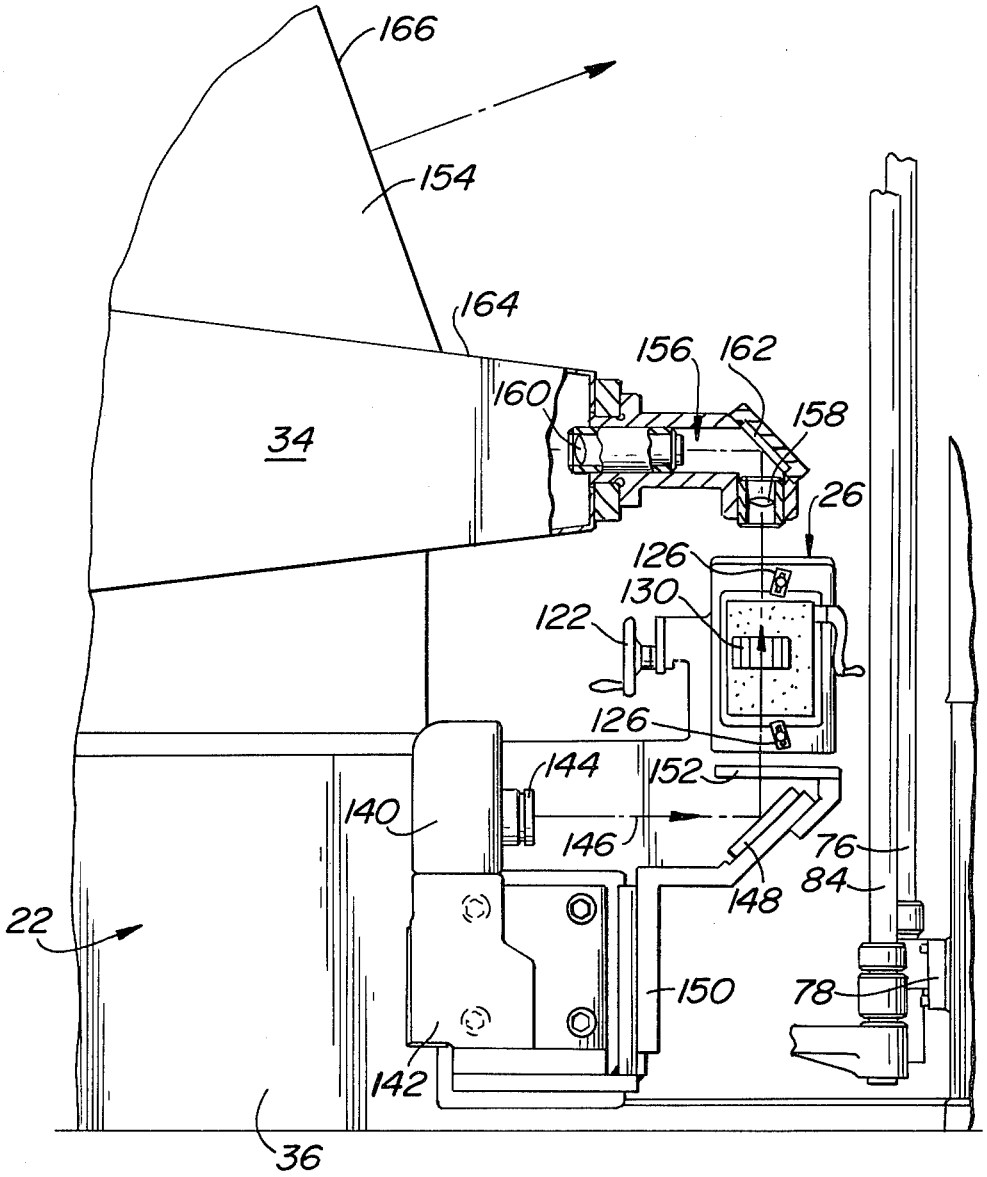
FIG. 4 is a sectional view taken along line 4—4 of FIG. 2.

Referring now to FIG. 4 the details of the optical display means will be discribed. As noted heretofore the optical display means is a shadowgraph type device which basically includes means for projecting a beam of light past the workpiece and through a lens system so that the shadow of the workpiece is projected onto a screen. A desired profile may be displayed on the screen, via the use of an overlay, to compare the shape of the actual workpiece to the desired shape during the cutting operation. The shadowgraph assembly 34 includes a lamp housing 140 mounted by a bracket 142 on the base 36 of the fixed frame 22. The lamp housing 140 includes an electric lamp (not shown) for producing light and providing the same as a beam through a magnifying lens 144 in the direction of the arrow 146. The light beam is directed to an angularly mounted mirror 148 so that the light beam 146 is aimed vertically upward. The mirror 148 is mounted by a bracket 150 onto the fixed frame. A protective, transparent plate 152 is mounted over the mirror to enable the light ray to pass therethrough but to protect the mirror from any falling debris created during grinding. The mirror is located below the workpiece holding table 26 so that when a workpiece 130 is mounted on the table the light beam 146 is directed thereon. The workpiece thus imparts its shadow into the light beam.

The shadowgraph 34 includes a light ray receiving portion 154 fixedly secured to the fixed frame 22. The portion 154 includes a lens assembly 156 including plural lens elements 158 and 160 and an angularly extending mirror 162 for receiving the shadowed beam of light 146, for focusing the same and providing the focused beam horizontally down a flared sealed housing 164. A mirror (not shown) is located within the housing 164 at the end thereof and is arranged to project the light beam forward to illuminate a screen 166. Accordingly, the greatly enlarged shadow of the workpiece appears on the screen 166. The machinist can thus readily compare the actual profile of the workpiece to a desired profile (provided in the form of an overlay on the screen 166), thereby facilitating grinding.

Figure 6:
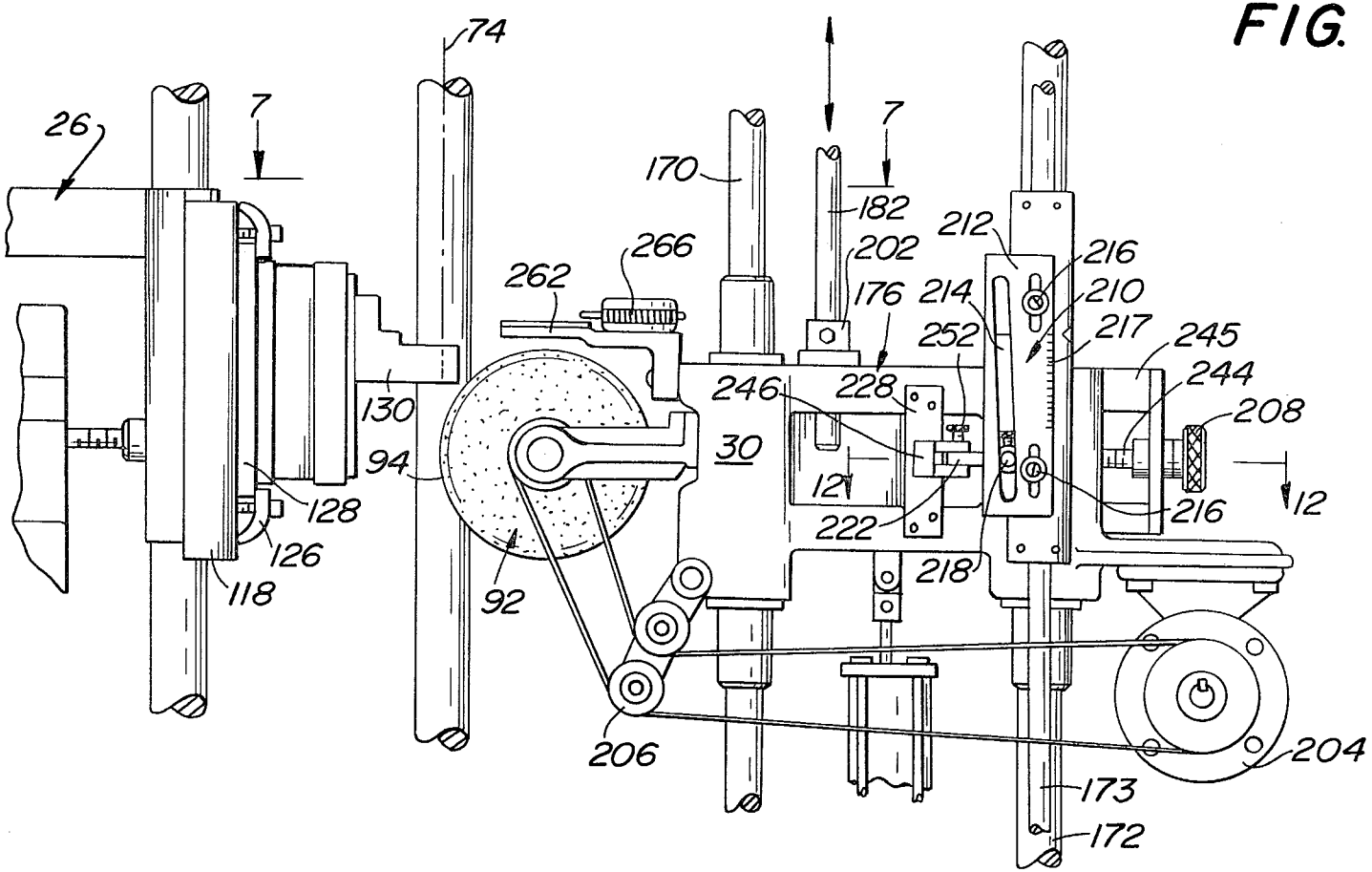
FIG. 6 is an enlarged, side-elevational view of a portion of the apparatus shown in FIG. 2.
Figure 12:
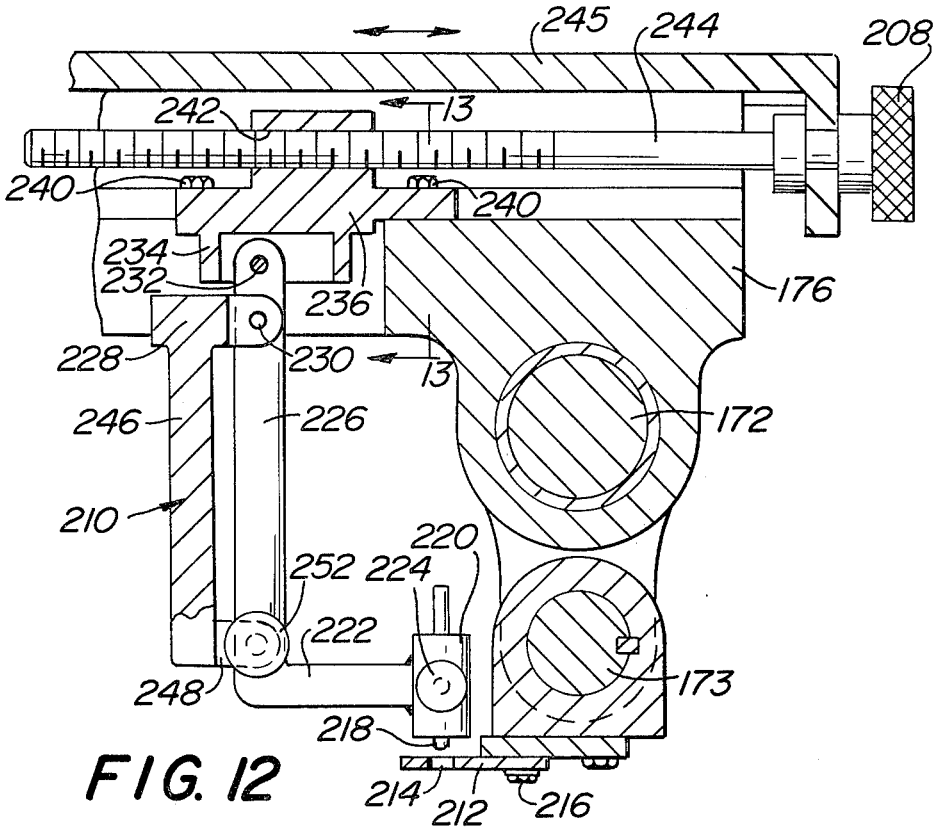
FIG. 12 is a sectional view taken along the line 12—12 of FIG. 6.
Figure 13:
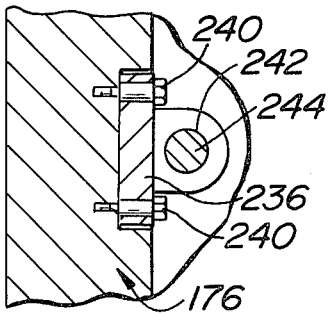
FIG. 13 is a sectional view taken along the line 13—13 of FIG. 12.

Turning now to FIGS. 2, 6 and 11, the details of the frame supporting the grinding means 30 will be described. To that end the frame basically comprises the upper and lower movable supports 68 and 70, respectively, described heretofore, and three vertically extending connecting rods 170, 172 and 173. The rods are fixedly secured vertically between the members 68 and 70 by nuts 174. The grinding means 30 includes a carriage 176 mounted on the rods 170 and 172 for sliding movement up and down said rods. The carriage 176 is reciprocated up and down the rods 170 and 172 under the control of an electric motor 178. The motor is connected to a rotating slide assembly 180, to be described in detail later. The rotating slide assembly is arranged for translating the rotary motion of the motor's output shaft into a vertical reciprocating motion which is coupled to a vertical drive rod 182. The drive rod is fixedly secured to the carriage 176 of the grinding means 30. The motor 178 is mounted on the grinding means frame via an angularly projecting bracket extending from upper movable support 68.

Turning now to FIG. 9, the details of the rotating slide assembly 180 will be described. The rotary drive shaft of the electric motor 178 is fixedly secured to a wheel 184. The wheel includes an opposed pair of radial spokes 186. A slot 188 (FIGS. 9 and 10) extends radially outward along one of the spokes 186. A projection bearing 190 is mounted within slot 188. The radial location of the projection bearing is adjustable, for reasons to be described hereinafter. Once the radial position is established a nut 192 is tightened on the bearing to hold the bearing at the desired location in slot 188. The bearing includes a roller portion 194 which is located in a horizontal slot 196 in a bracket 198. The bracket 198 is fixedly secured to an intermediate portion of the rod 182. The free end of rod 182 extends upward through a bearing sleeve 200 on the upper support 68 to ensure that when the rod is reciprocated it always remains vertical and does not skew. The bottom portion of the rod 182 is fixedly secured, via a coupling 202, to the carriage 176 of the grinding means 30.

Operation of the rotating slide assembly 180 is as follows: Rotation of the motor output shaft causes the wheel 180 to rotate in the direction of the arrow shown in FIG. 9. This causes the roller surface 194 of bearing 190 to carry the bracket 198 in a reciprocating vertical path, while the bearing slides down the slot 196. The length of the vertical stroke of the rod 182 is determined by the position of the bearing in the slot 188 of the wheel 180. To that end, the further radially outward the bearing is located, the greater the stroke of the drive rod 182.

As described heretofore the grinding means 30 includes the rotary wheel 92. The wheel is driven or rotated by an electric motor 204 and an associated drive belt assembly 206. The motor and drive belt assembly are mounted on the carriage 176.

As noted heretofore it is crucial that the peripheral surface of the grinding wheel be tangent to the axis 74 of the pantograph output so that the grinding wheel precisely follows the movement of the guiding means 36. In order to ensure that the wheel 92 is tangent to axis 74 means are provided to move the grinding wheel 92 toward or away from the axis 74, under the control of an adjustment wheel 208. The wheel is connected so that when rotated it moves the grinding wheel 92 horizontally with respect to the carriage 176 toward or away from the axis 74 depending upon the direction of rotation of the wheel 208.

In accordance with another aspect of the instant invention, the carriage 176 includes means for causing the grinding wheel to reciprocate slightly horizontally during vertical reciprocation of the carriage so that the surface of the grinding wheel follows a path which is at an acute angle to the vertical axis 74. This feature enables the grinding of a bevelled edge onto a workpiece.

The means for establishing the angularly oriented movement of the grinding wheel 92 comprises a camming assembly 210 mounted on the carriage 176 of the grinding means 30. The details of the camming means 210 are best seen by reference to FIGS. 6, 11, 12 and 13. As can be seen therein a camming means 210 includes a cam plate 212 having an angularly oriented, elongated slot 214. The angle that slot 214 makes to the vertical axis establishes the angle of the bevel to be ground onto the workpiece 130 by the grinding wheel 92. The plate 212 is fixedly mounted, i.e. it does not reciprocate, on the rod 173, via screws 216. The screws extend through vertically extending slots so that the vertical position of the plate 212 can be adjusted in accordance with indicia 217 appearing thereon. This feature enables the adjustment of the length of the bevel to be ground on the workpiece.

A follower 218 is adapted to be extended into the slot 214 when a bevelled edge is desired. The follower 218 is connected to the end 220 of a lever arm 222. The follower 218 is reciprocable in the end 220 from a retracted position, like that shown in FIG. 12, to an extended position wherein the follower is located within the cam slot 214. A thumb screw 224 is provided to lock the follower in either the extended or retracted position. The lever arm 222 includes a normally extending rear portion 226 which is secured to a bracket 228, via a vertically oriented pivot pin 230 extending through the lever arm. The bracket 228 is fixedly secured to the carriage 176. The end of the lever arm is secured via a pivot pin 232 to a yoke 234. The yoke is fixedly secured to a bracket 236. The bracket is located within a slot 238 in the carriage frame 176 and is retained by plural bolts 240 extending through elongated slots 241. The bracket 236 includes a threaded passage 242 through which a threaded shaft 244 extends. The shaft 244 is coupled to a movable support 245 and is connected to the grinding wheel adjustment wheel 208. The grinding wheel 92 is mounted on the support 245.

The bracket 228 includes a horizontally extending arm 246 fixedly secured thereto. The free end of arm 246 is in the form of a pair of spaced flanges 248 defining a horizontal slot 250 therebetween. A thumb screw 252 extends through the upper flange into the slot 250. An intermediate portion of the lever arm 222 is located within slot 250.

When a vertical edge is to be ground on a workpiece the thumb screw 252 is screwed into engagement with the lever arm portion extending in slot 250 so that the lever arm is effectively rigidly secured to the bracket 228. The follower 218 is retracted within end portion 220 so that it is not located within the slot 214 of the camming plate 212. If adjustment of the cutting wheel is required to make its edge tangent to axis 74, the hand wheel 208 is rotated causing the shaft 244 to carry the grinding wheel coupled thereto toward or away from the axis 74, depending on the direction of rotation of the wheel 208. Once the adjustment is made the grinding wheel remains in a fixed position horizontally. Accordingly, when the grinding wheel is reciprocated vertically it will cut a vertical edge on the workpiece 130.

When it is desired that the grinding wheel be moved laterally, i.e., horizontally, as it is reciprocated up and down, to effectuate the bevelling of the workpiece, then follower 218 is extended from portion 220 into the slot 214. The thumb screw 252 is then released to enable the lever arm 222 to pivot about the vertical pivot pin 230. Accordingly, when the carriage is reciprocated up and down by the reciprocating rod 182, the follower 218 slides along slot 214. Inasmuch as slot 214 is fixed and extends at an acute angle to the vertical axis, the sliding of the follower in the slot causes the lever arm to rotate about pivot pin 230. This action carries the bracket 236 in a reciprocating horizontal movement inward and outward with respect to the axis 74. Accordingly, the grinding wheel carried thereby is carried toward and away from the axis 74 during each vertical reciprocation of the carriage to effect a bevelling of the workpiece edge.

Additional plates 212 having differently oriented slots 214 can be used to produce different bevelled edges.

In order to insure that the workpiece is ground to the precise profile required it is important that the profile of the grinding edge 94 of wheel 92 be identical to the profile of the tip of the stylus 98 which is used to follow the template. In order to precisely contour the grinding wheel a diamond is utilized. The contouring of the grinding wheel by a diamond is shown in FIG. 8. As can be seen therein the diamond 256, with a pyramid shape, is mounted in a support 258 horizontally on the workpiece table 26 so that its working end is aligned with the axis 74.

In order to align the diamond with the axis 74 the grinding means 30 includes a gauge assembly 260 mounted on a bracket 262. The gauge assembly 260 includes a gauge bar or rod 264 of a predetermined length and a communicating dial indicator 266. The positioning of the diamond is accomplished by moving the work table horizontally until the working end of the diamond contacts the gauge bar to cause the gauge indicator 266 to read zero.

The grinding wheel 92 is then ready for contouring. The contouring of the wheel is accomplished by using a template 270 in the shape of the diamond 256. The ratio of the size of the diamond 256 to the template 270 is the same as the pantograph reduction ratio. The diamond template 270 is mounted on a bar 272 adapted to be secured in slot 100 of the template holding table 24 and held in place therein by plural bolts 274. The stylus 98 which is to be utilized is then mounted in the stylus holder of the guiding means. The stylus is then moved so that the entire working end of the stylus is traversed by the tip 276 of the diamond template 270. This moves the grinding wheel relative to the diamond 256 so that the reciprocation of the grinding wheel along axis 74 results in the contouring of precise stylus profile on the edge 94 of the grinding wheel 92.

As will be appreciated by those skilled in the art, with the instant invention one is able to precisely contour a grinding wheel to any desired shape. This feature is of extreme importance in that a contoured grinding wheel can be used to effect the profiling of a workpiece by the mere reciprocation of the grinding wheel with respect to the workpiece. For example, if the grinding wheel is contoured to the shape of the recesses between gear-teeth, the grinding of a gear can be effected by merely extending the grinding wheel into the workpiece radially to grind each tooth. Such an operation is much more efficient than moving a cutting wheel through the profile of each tooth.

As should be appreciated from the foregoing, the grinding apparatus of the instant invention is simple in construction, and enables a shadowgraph to be located adjacent the workpiece to provide a constantly focussed image of the workpiece while the workpiece is ground. The movable support assembly of the instant invention is simple in construction, yet enables the grinding means carried by a pantograph to follow the movement of guiding means yet not interfering with the projection of the workpiece image during the grinding operation. Moreover, the grinding apparatus of the instant invention is arranged to effect the profiling of a workpiece via the movement of a stylus about the periphery of a template or via the movement of a table to follow the contour of a desired profile displayed on the shadowgraph. Further still, the grinding means includes means for readily effecting the bevelling of any workpiece edge.

Without further elaboration the foregoing will so fully illustrate my invention that others may, by applying current or future knowledge, readily adapt the same for use under various conditions of service.

What is claimed as the invention is:

1. A profile grinding apparatus comprising a stationary frame, a first table adapted for holding a template thereon and mounted on said frame, a second table mounted on said frame, said second table being arranged to hold a workpiece at a fixed position, pantograph means movable in a horizontal plane and comprising guiding means for movement in said plane, first movable support means mounted on said stationary frame and coupled to said pantograph means for following the movement of said guiding means, second movable support means mounted on said stationary frame at a spaced location below said first movable support means and connected to said first movable support means for corresponding movement therewith, grinding means carried by said first and second movable support means and arranged for reciprocation along a vertical axis between said first and second support means to grind a countour on a workpiece held on said second table, both said first and second movable support means being mounted on said stationary frame by a movable support assembly, said movable support assembly comprising first rod means having a longitudinal axis about which said first rod means is rotatable, said first rod means being mounted on said stationary frame with said longitudinal axis vertical, first bracket means fixedly secured to said first rod means, second bracket means fixedly secured to said first rod means below said first bracket means, second rod means having a logitudinal axis about which said second rod means is rotatable, said second rod means being supported with its axis vertical and for rotation thereabout by first and second bracket means, third bracket means fixedly secured to said second rod means, fourth bracket means fixedly secured to said second rod means below said third bracket means, said third bracket means being pivotable connected to said pantograph means and to said first movable support means at a vertical pivot axis, said fourth bracket being pivotably connected to said second movable support means at said vertical pivot axis, said grinding means including a grinding surface located tangent to said vertical pivot axis.

2. The apparatus of claim 1 wherein said guiding means comprises a horizontal stylus adapted to traverse the periphery of a template located on said first table, said stylus being movable rectilinearly in all directions in a horizontal plane and also pivotable about a vertical axis.

3. The apparatus of claim 1 wherein said first table includes means for connecting said guiding means thereto and means for moving said table and the connected guiding means to any position in a horizontal plane.

4. The apparatus of claim 3 wherein said guiding means comprises a vertical shaft mounted for rotation about a vertical axis and for disposition with an opening in said first table.

5. A profile grinding apparatus comprising a stationary frame, a first table adapted for holding a template thereon and mounted on said frame, a second table mounted on said frame, said second table being arranged to hold a workpiece at a fixed position, pantograph means movable in a horizontal plane and comprising guiding means for movement in said plane, first movable support means mounted on said stationary frame and coupled to said pantograph means for allowing the movement of said guiding means, second movable support means mounted on said stationary frame at a spaced location below said first movable support means and connected to said first movable support means for corresponding movement therewith, grinding means carried by said first and second movable support means and arranged for reciprocation along a vertical axis between said first and second support means to grind a contour on a workpiece held on said second table, both said first and second support means being mounted on said stationary frame by a movable support assembly, said movable support assembly comprising first rod means having a longitudinal axis about which said first rod means is rotatable, said first rod means being mounted on said stationary frame with said longitudinal axis vertical, first bracket means fixedly secured to said first rod means, second bracket means fixedly secured to said first rod means below said first bracket means, second rod means having a longitudinal axis about which said second rod means is rotatable, said second rod means being supported with its axis vertical and for rotation thereabout by said first and second bracket means, third bracket means fixedly secured to said second rod means, fourth bracket means fixedly secured to said second rod means below said third bracket means, said third bracket means being pivotably connected to said pantograph means and to said first movable support means at a vertical pivot axis, said fourth bracket means being pivotably connected to said second movable support means at said vertical pivot axis, said grinding means including a grinding surface located tangent to said vertical pivot axis, and optical means fixedly mounted adjacent said second table for displaying a constantly focused image of the profile of said workpiece as said contour is ground.

6. The apparatus of claim 5 wherein said grinding means is adapted for reciprocation in a predetermined length stroke and at an acute angle to said vertical axis.

7. The apparatus of claim 6 wherein the length of said stroke is adjustable.

8. The apparatus of claim 5 wherein said guiding means comprises a horizontal stylus adapted to traverse the periphery of a template located on said first table, said stylus being movable rectilinearly in all directions in a horizontal plane and also pivotable about a vertical axis.

9. The apparatus of claim 8 wherein said grinding means is adapted for reciprocation in a predetermined length stroke and at an acute angle to said vertical axis.

10. The apparatus of claim 9 wherein the length of said stroke is adjustable.

11. A profile grinding apparatus comprising a stationary frame, a first table adapted for holding a template thereon and mounted on said frame, a second table mounted on said frame, said second table being arranged to hold a workpiece at a fixed position, pantograph means movable in a horizontal plane and comprising guiding means for moving in said plane, first movable support means mounted on said stationary frame and coupled to said pantograph means for following the movement of said guiding means, second movable support means mounted on said stationary frame at a spaced location below said first movable support means and connected to said first movable support means for corresponding movement therewith, grinding means carried by said first and second movable support means and arranged for reciprocation along a vertical axis between said first and second support means to grind a contour on a workpiece held on said second table, both said first and second movable support means being mounted on said stationary frame by a movable support assembly, said movable support assembly comprising first rod means having a longitudinal axis about which said first rod means is rotatable, said first rod means being mounted on said stationary frame with said longitudinal axis vertical, first bracket means fixedly secured to said first rod means, second bracket means fixedly secured to said first rod means below said first bracket means, second rod means having a longitudinal axis about which said second rod means is rotatable, said second rod means being supported with its axis vertical and for rotation thereabout by said first and second bracket means, third bracket means fixedly secured to said second rod means, fourth bracket means fixedly secured to said second rod means below said third bracket means, said third bracket means being pivotably connected to said pantograph means and to said first movable support means at a vertical pivot axis, said fourth bracket means being pivotably connected to said second movable support means at said vertical pivot axis, said grinding means including a grinding surface located tangent to said vertical pivot axis, and optical means fixedly mounted adjacent said second table for displaying a constantly focused image of a profile of said workpiece as said contour is ground, said optical means comprising lens means mounted on said stationary frame adjacent said second table and having a viewing screen for displaying a projected image of the profile of the workpiece held on said second table.

12. The apparatus of claim 11 wherein said guiding means comprises a horizontal stylus adapted to traverse the periphery of a template located on said first table, said stylus being movable rectilinearly in all directions in a horizontal plane and also pivotable about a vertical axis.

13. The apparatus of claim 11 wherein said first table includes means for connecting said guiding means thereto and means for moving said table and the connected guiding means to any position in a horizontal plane.

14. The apparatus of claim 13 wherein said guiding means comprises a vertical shaft mounted for rotation about a vertical axis and for disposition with an opening in said first table.

* * * * *